US006579144B1

(12) United States Patent
Chang

(10) Patent No.: US 6,579,144 B1
(45) Date of Patent: Jun. 17, 2003

(54) METHOD OF MANUFACTURING ENVIRONMENTAL PROTECTIVE PAPER DOLL

(75) Inventor: Paul Chang, Taipei (TW)

(73) Assignee: Cheer Stars International Ltd., Taipei (TW)

( * ) Notice: Subject to any disclaimer, the term of this patent is extended or adjusted under 35 U.S.C. 154(b) by 0 days.

(21) Appl. No.: 10/189,002

(22) Filed: Jul. 5, 2002

(51) Int. Cl.[7] ..... A63H 3/00
(52) U.S. Cl. ..... 446/385
(58) Field of Search ..... 446/268, 385, 446/387, 388, 97

(56) References Cited

U.S. PATENT DOCUMENTS 3,646,705 A * 3/1972 Nicholson ..... 446/98
4,659,319 A * 4/1987 Blair ..... 156/58

* cited by examiner

*Primary Examiner*—Jacob K. Ackun
(74) *Attorney, Agent, or Firm*—Leong C. Lei

(57) ABSTRACT

A method of manufacturing an environmental protective paper doll includes the steps of using recycle paper as the manufacturing material; adding appropriate proportion of water to the paper pulp after a slight filtering to make a paste; pressing the vacuum mold on the protruded mold plate after tying the net; submerging in a trough containing the pasty paper pulp; drawing out the liquid in the vacuum shaping mold to facilitate the formation of an embryo layer with appropriate thickness on the tying net of the protrusion member; engaging the upper mold and the lower mold together and preliminarily removing the water content; baking the semi-finished embryo layer for dehydration; pasting the front and rear halves with glue; trimming the rough edge and coating the paper surface with a layer of golden paint to increase the hardness of the surface; and then painting with the stylish colors and forming the paper doll.

2 Claims, 5 Drawing Sheets

METHOD OF MANUFACTURING ENVIRONMENTAL PROTECTIVE PAPER DOLL

BACKGROUND OF THE INVENTION (a) Field of the Invention

The present invention relates to a method of manufacturing an environmental protective paper doll.

(b) Description of the Prior Art

The manufacturing method for traditional decorative products usually adopts the plastic injection manufacturing technology; the injection of melted plastic liquid into the mold is applied under high pressure to produce a doll form. With the color painting on the surface of the doll, or decorative accessories hung on the doll, a doll is produced for viewing.

There is another manufacturing method different from the aforementioned plastic injection formation. After the resin material is melted by heating, the melted resin liquid is poured into a mold and the bubbles inside are discharged. The liquefied resin flows into the mold naturally, or shoots into the mold rapidly by centrifugal force to form a casing of resin material. Such method can produce all kinds of decorative products in different forms. However, the decorative products produced by the foregoing manufacturing method cannot be recycled or decomposed into garbage effectively after the product is damaged or becomes a waste product. It definitely does not meet the requirement of environmental protection.

Before the patent application of the present invention, there are issued patents regarding the manufacturing of paper toys, but most of the prior art toys or decorations use thick paper as material, and a profile of specific size is cut, and then the pieces are stacked and glued to form a standing doll. Such doll is only a standing doll made of plat pieces for viewing, and does not have the form of a human figure similar to the real one.

Therefore it needs to remanufacture the pattern for the three-dimensional vertical design if we need to manufacture doll with recycle paper as the material to meet the environmental protection requirements. It can greatly reduce the damages to the environment by adopting the natural corrugated surface for the doll, making a lifelike, which is definitely valuable to the industry.

SUMMARY OF THE INVENTION

The present invention relates to a method manufacturing an environmental protective paper doll.

The primary objective of the present invention is to provide a method of manufacturing an environmental protective paper doll, such that the doll can be made of paper completely, and the recycled paper is reused to form the paper pulp and then used as the material for manufacturing the doll. It certainly complies with the standards of environmental protection in all countries.

The secondary objective of the present invention is to provide a method of manufacturing an environmental protective paper doll, using a special manufacturing technique to make a paper doll having a profile of natural wrinkles. The coupling method for the formation of paper casing of the paper doll resembles the external profile of human beings, and makes the products lifelike, and has a very high value for appreciation. It greatly enhances the utility of the decoration.

Totally using paper as the basic raw material for the paper product can overcome the shortcomings of the general products made by plastic injection. It changes the current manufacturing procedure of making dolls and decorative products, and effectively improves the quality of the reality.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
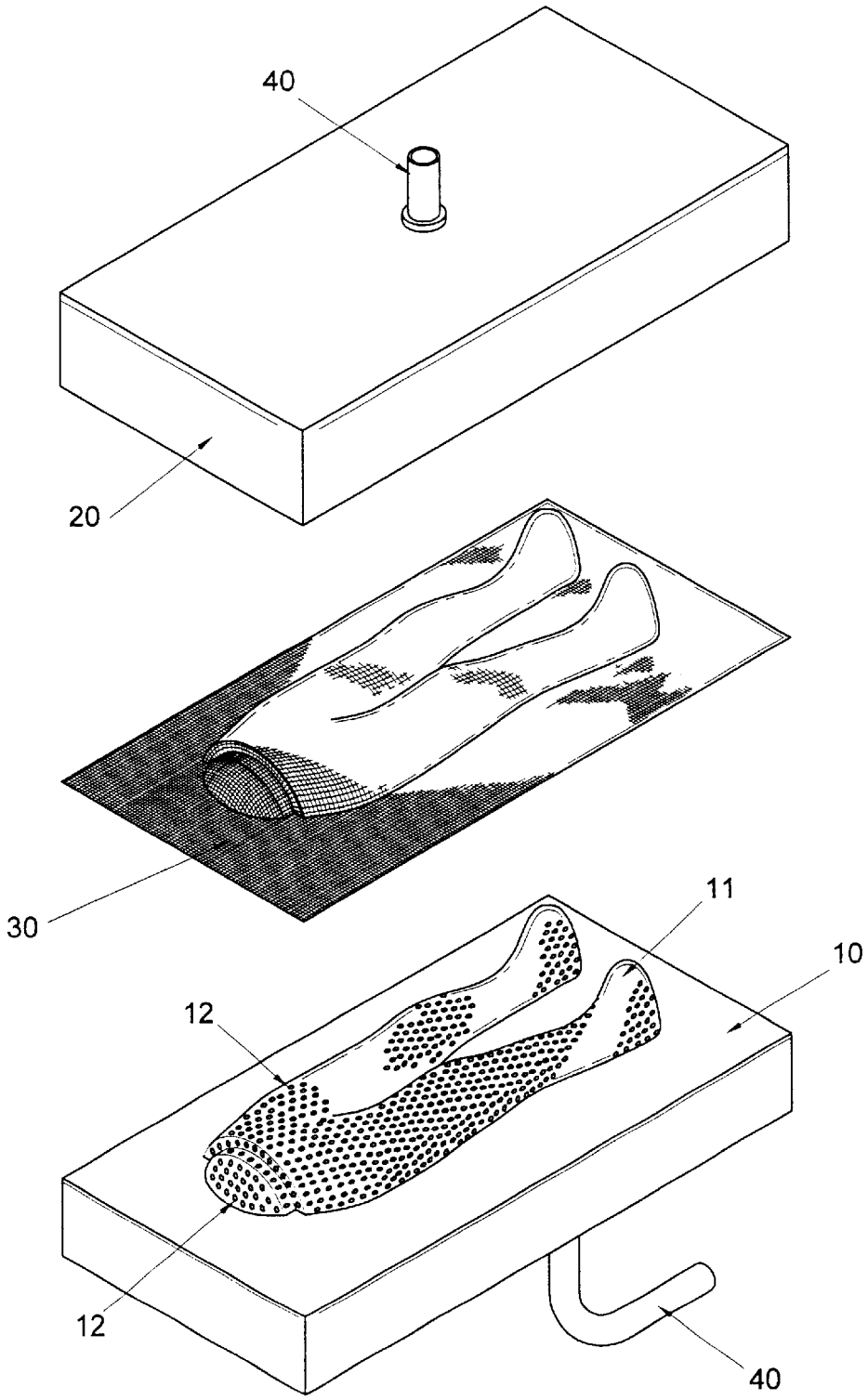
FIG. 1 is a schematic diagram of manufacturing the mold according to a preferred embodiment of the present invention.

Referring to FIG. 1 for the schematic diagram of the mold formation of the present invention, which comprises a male mold 10, a female mold 20, a protrusion member 11 disposed on the male mold, a plurality of vacuum air (liquid) holes 12 disposed on the protrusion of the protrusion member 11, a tying net layer 30 having an appropriate holes being attached and laid on the protrusion member 11, and the male mold 10 and the female mold 20 are coupled to an air (liquid) pipe 40 of a pumping equipment.

Figure 2:
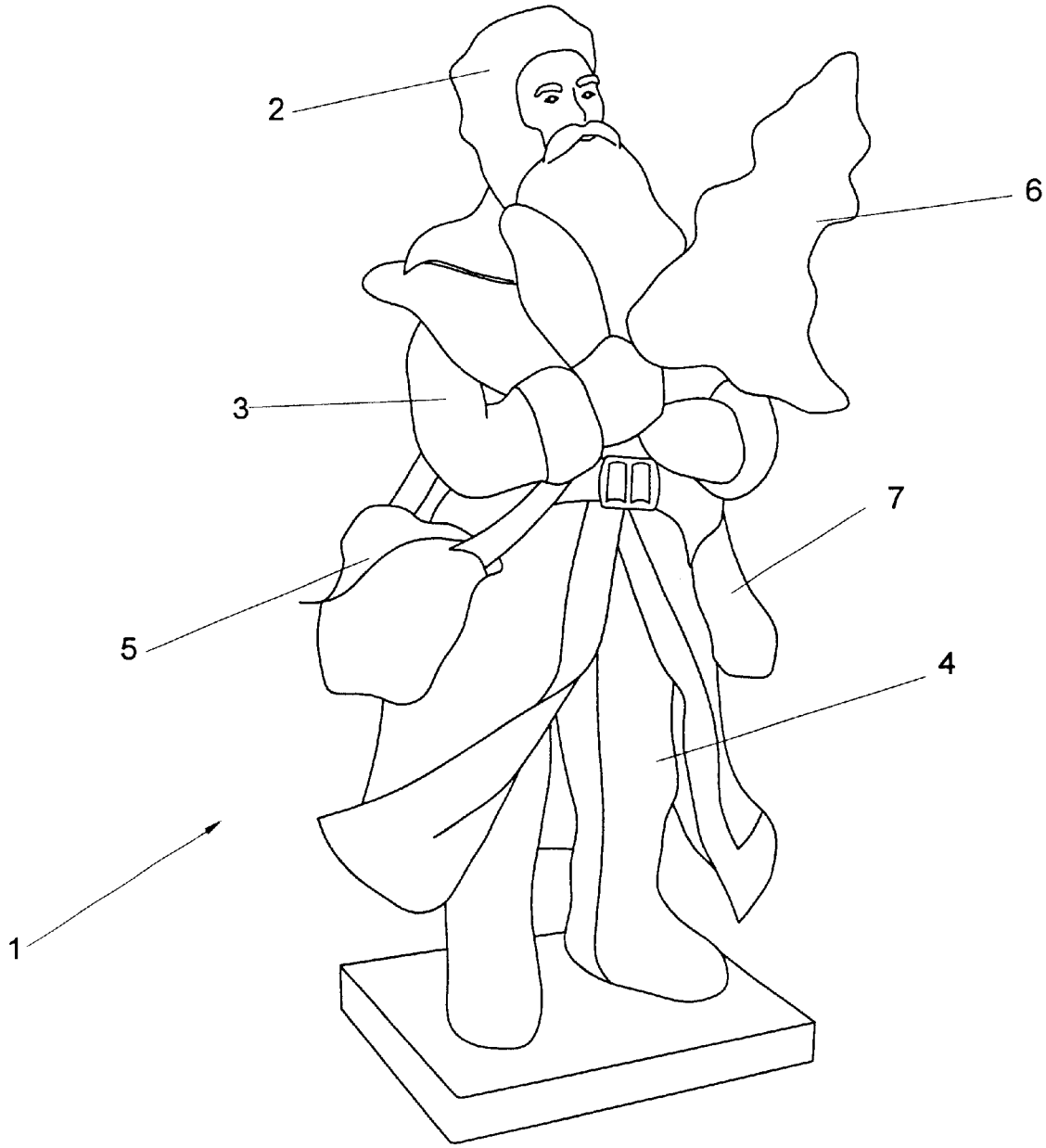
FIG. 2 is a diagram showing the external appearance of the finished product of a preferred embodiment of the present invention.

Please refer to FIG. 2 for the paper doll 1 of a preferred embodiment of the present invention, comprising a head 2, a body 3, feet 4, and related accessories 5, 7 which are made of paper, having the feature of hollow interior in order to save materials; the natural wrinkled material for the overall embryo layer 50 increases the delicacy of the doll.

Figure 3:
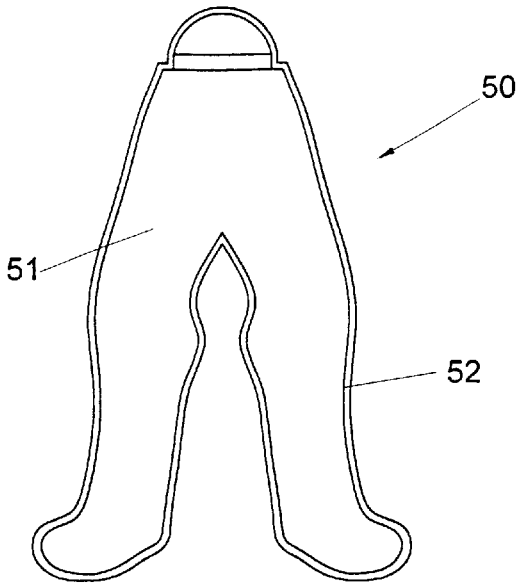
FIG. 3 is a diagram showing the external appearance of the semi-finished product of a preferred embodiment of the present invention.
Figure 4:
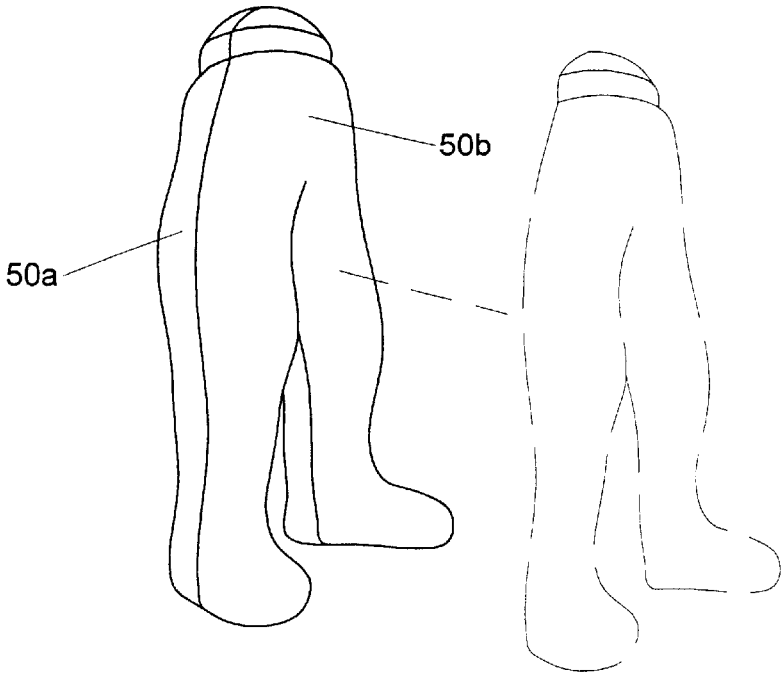
FIG. 4 is a schematic diagram showing the assembly of the semi-finished product of a preferred embodiment of the present invention.
Figure 5:
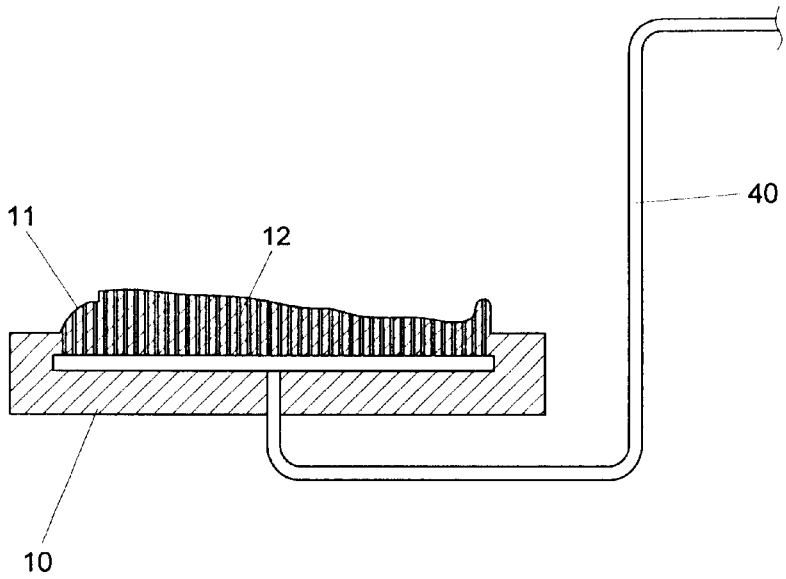
FIG. 5 is a schematic diagram of the male mold containing the protrusion member of the present invention.
Figure 6:
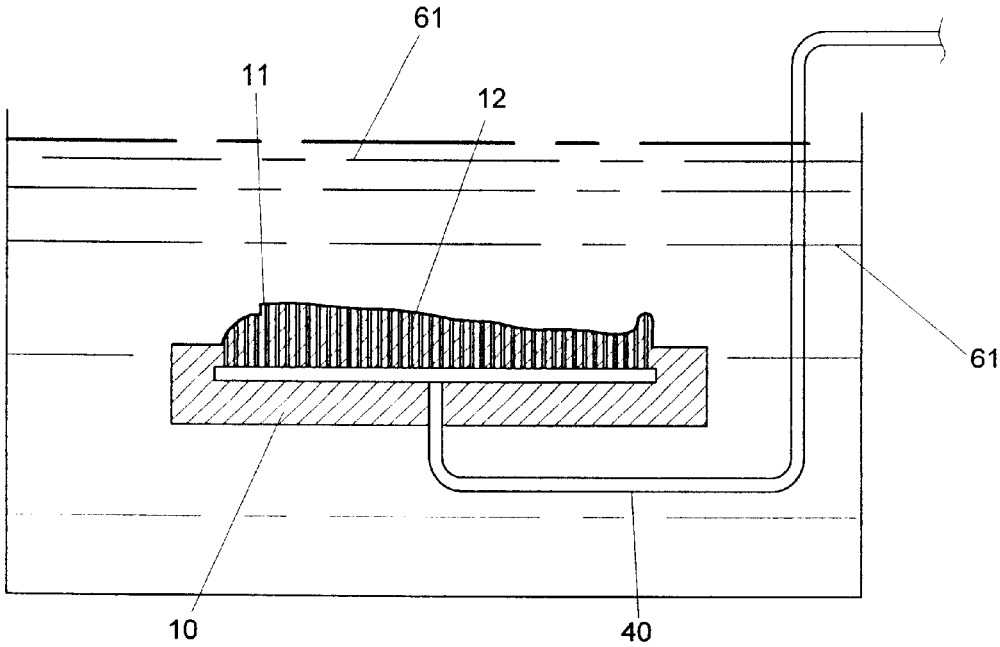
FIG. 6 is a schematic diagram showing the submerging of the male mold and its protrusion member into deposition tank according to the present invention.
Figure 7:
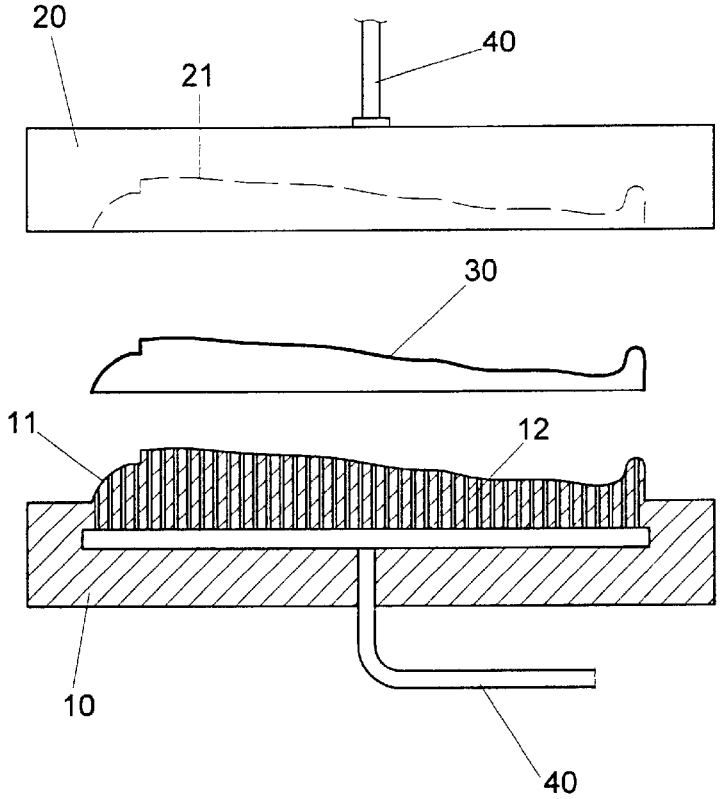
FIG. 7 is a schematic diagram showing the laying of tying net on the protrusion member of the male mold according to the present invention.
Figure 8:
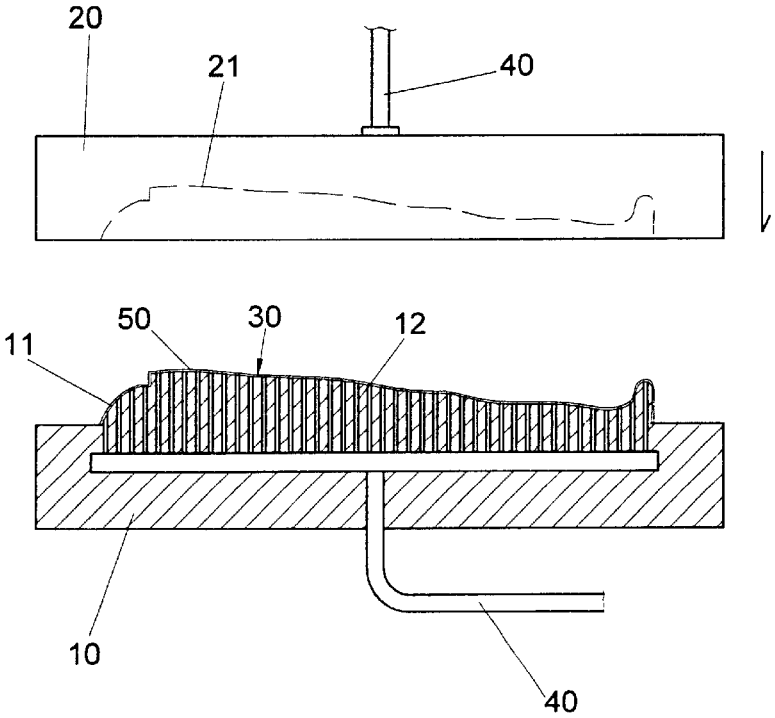
FIG. 8 is a schematic diagram of the male mold and female mold of the present invention.

Please refer to FIG. 3. The mold of the present invention as shown in FIG. 1 condenses the paper embryo layer 50 in the deposition tank containing paper pulp, and each embryo layer 50 has a hollow cross section 51 in its interior, and a complete edge 52 around its periphery. Glue is applied on the edge 52 to stick the two halves of the sectioned embryo layer 50*a*, 50*b* together to form a three-dimensional object as shown in FIG. 4.

Please refer to FIGS. 5 to 8. The manufacturing method of the environmental protective paper doll, comprising the following steps of:

1. Using recycle paper as material, filly submerging the waste paper into water with appropriate proportion, and evenly mixing the paper into a pasty paper pulp 61 by a high-speed mixing machine, placing the paper pulp 61 into a deposition tank;
2. Making a shaping male mold 10, which having a protrusion member 11 on it, and making a shaping female mold 20, which having a recession 21 on it, such that the protrusion member having an air exhaustion passage 12, and the protrusion member 11 being coupled to the air (liquid) suction pipe 40 of a vacuum suction equipment;
3. Submerging the protrusion member 11 of the male mold 10 into the depositing tank 61 containing paper pulp, and laying a layer of tying net 30 on the protrusion member 11, and depositing a paper layer with appropriate thickness on the protrusion member 11 by drawing out the liquid in the vacuum shaping mold to form a casing body with embryo layer 50;
4. Lowering the female mold 20 by oil pressure device to engage with the male mold 10, and the engaged molds flowing on the deposition tank 60 after a specified time period and converting the paper pulp attached on the surface of the tying net 30 on the protrusion member 11 to form an embryo layer 50 of 3~5 mm thick, and the vacuum shaping molds being detached automatically after eliminating the water content;
5. Further removing the water content in the embryo layer 50 of the detached folds (which can be accomplished by either baking or drying by natural wind);
6. Pasting the embryo layer 50 according to the desired profile of the paper doll 1, and removing the rough edges on the two half sectioned molds 50*a*, 50*b* after the two halves of the molds being engaged as one;
7. Coating the fully dried paper embryo layer 50 with a golden paint to increase the hardness of the surface, and painting the doll with styling colors and pasting the sections of the head 2, body 3, hands, and legs 4 to form the paper doll with an external appearance of a human body. Additionally, hand kneaded paper accessories 5~7 such as the backpack, coat, and handheld object, etc are painted with color. It completes the pattern of the doll.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A method of manufacturing environmental protective paper doll, comprising steps of:

a. dipping waste recycle paper into water, and mixing said waste recycle paper with said water into a pasty paper pulp by a mixing machine;

b. making a shaping male mold and a shaping female mold, said male mold having a protrusion member with an exhaustion passage, said female mold having a recession, said protrusion member being coupled to a vacuum suction equipment;

c. submerging said protrusion member of said male mold into a depositing tank containing paper pulp, laying a layer of tying net on said protrusion member, and depositing a paper layer on said protrusion member by drawing out liquid in said vacuum shaping mold to form a casing body with embryo layer;

d. lowering said female mold to engage with said male mold, and the engaged molds flowing on said depositing tank after a specified time period and converting said paper pulp attached on a surface of said tying net on said protrusion member to form an embryo layer of 3~5 mm thick, and said shaping molds being detached automatically after eliminating water content;

e. further removing water content from said embryo layer of the detached molds;

f. pasting said embryo layer according to desired profile of a paper doll, and removing rough edges on two half sectioned molds after the two half sectioned molds are engaged as one;

g. coating said embryo layer with a golden paint to increase surface hardness, and painting said doll with styling colors and pasting sections of head, body, hands, and legs to form a paper doll.

2. The method of manufacturing environmental protective paper doll as claimed in claim 1, wherein water of said embryo layer is removed by baking.

* * * * *